US006227138B1

(12) United States Patent
Breivik et al.

(10) Patent No.: US 6,227,138 B1
(45) Date of Patent: May 8, 2001

(54) SYSTEM FOR ANCHORING SHIPS

(75) Inventors: Kåre Breivik, Tau; Arne Smedal, Færvik; Kåre Syvertsen, Arendal, all of (NO)

(73) Assignee: Den Norske Stats Oljeselskap A.S., Stavanger (NO)

( * ) Notice: Subject to any disclaimer, the term of this patent is extended or adjusted under 35 U.S.C. 154(b) by 0 days.

(21) Appl. No.: 09/125,459

(22) PCT Filed: Aug. 9, 1996

(86) PCT No.: PCT/NO96/00203

§ 371 Date: Dec. 7, 1998

§ 102(e) Date: Dec. 7, 1998

(87) PCT Pub. No.: WO97/30889

PCT Pub. Date: Aug. 28, 1997

(30) Foreign Application Priority Data

Feb. 21, 1996 (NO) ..... 960698

(51) Int. Cl.[7] ..... B63B 21/24
(52) U.S. Cl. ..... 114/293
(58) Field of Search ..... 441/5; 114/230, 114/293, 294, 295, 296, 230.2, 230.1

(56) References Cited

U.S. PATENT DOCUMENTS

| | | | | |
|---|---|---|---|---|
| 3,430,597 | | 3/1969 | Zunderdorp | 114/230 |
| 3,455,270 | | 7/1969 | Mascenik et al. | 114/230 |
| 3,670,686 | | 6/1972 | Reynolds | 114/230 |
| 3,750,723 | * | 8/1973 | Schirtzinger | 141/388 |
| 5,816,183 | * | 10/1998 | Braud et al. | 114/230 |

FOREIGN PATENT DOCUMENTS

| | | |
|---|---|---|
| 2 183 581 | 1/1987 | (GB) . |
| 93/24731 | 12/1993 | (WO) . |

* cited by examiner

*Primary Examiner*—Stephen Avila
*Assistant Examiner*—Andrew Wright
(74) *Attorney, Agent, or Firm*—Foley & Lardner

(57) ABSTRACT

System for mooring ships, in particular for operations in connection with oil and gas activity, whereby a ship is equipped with a mooring device at its bow portion. There is included an anchor device located at the seabed, as well as at least one anchoring line adapted to connect the anchor device to the mooring device on the ship. The anchor device is an essentially permanent anchor device, preferably in the form of a suction anchor, gravitation anchor or pile anchor. The anchor device is provided with a swivel device for the anchoring line. A buoyant body is attached to a middle portion of the anchoring line.

4 Claims, 2 Drawing Sheets

SYSTEM FOR ANCHORING SHIPS

This invention relates to a system for mooring ships, in particular for operations in connection with oil and gas activity, whereby the ships concerned are equipped with mooring means at their bow part, and where there is included anchor means located at the seabed, as well as at least one achoring line adapted to connect the anchor means to the mooring means on the ship.

In offshore oil and gas activity there is often the question of very important operations that can be difficult under certain conditions, and whereby there is usually involved transfer of fluids either between two ships, of which one can be moored, or between a pipeline connected to the anchor means at the seabed and a moored ship. Under varying and difficult conditions, whereby wind, waves and ocean current have influence, great stresses and forces can occur during such mooring and carrying out of these operations. Such stresses in the first place can lead to interruption of the operations and in the worst case can lead to wrecking and e.g. uncontrolled oil discharge. It is obvious that the system according to the invention depending on the circumstances, can also be utilized for other types of operations at sea, than in connection with oil and gas activity.

On the background of mooring systems being known for corresponding purposes, this invention involves novel and specific features as stated more closely in the claims.

Among the advantages obtained by means of the invention, it is emphasized in particular that the challenging operations mentioned, can be carried out under difficult conditions with higher security and reliability in most situations, compared to previously known methods and systems. In this connection it is to be noted in particular that the system according to the invention makes possible a type of elasticity or flexibility in the mooring and possibly the fluid transfer, that involves adaptation of the whole system according to the stresses and forces occurring during the operations to be performed.

Figure 1:
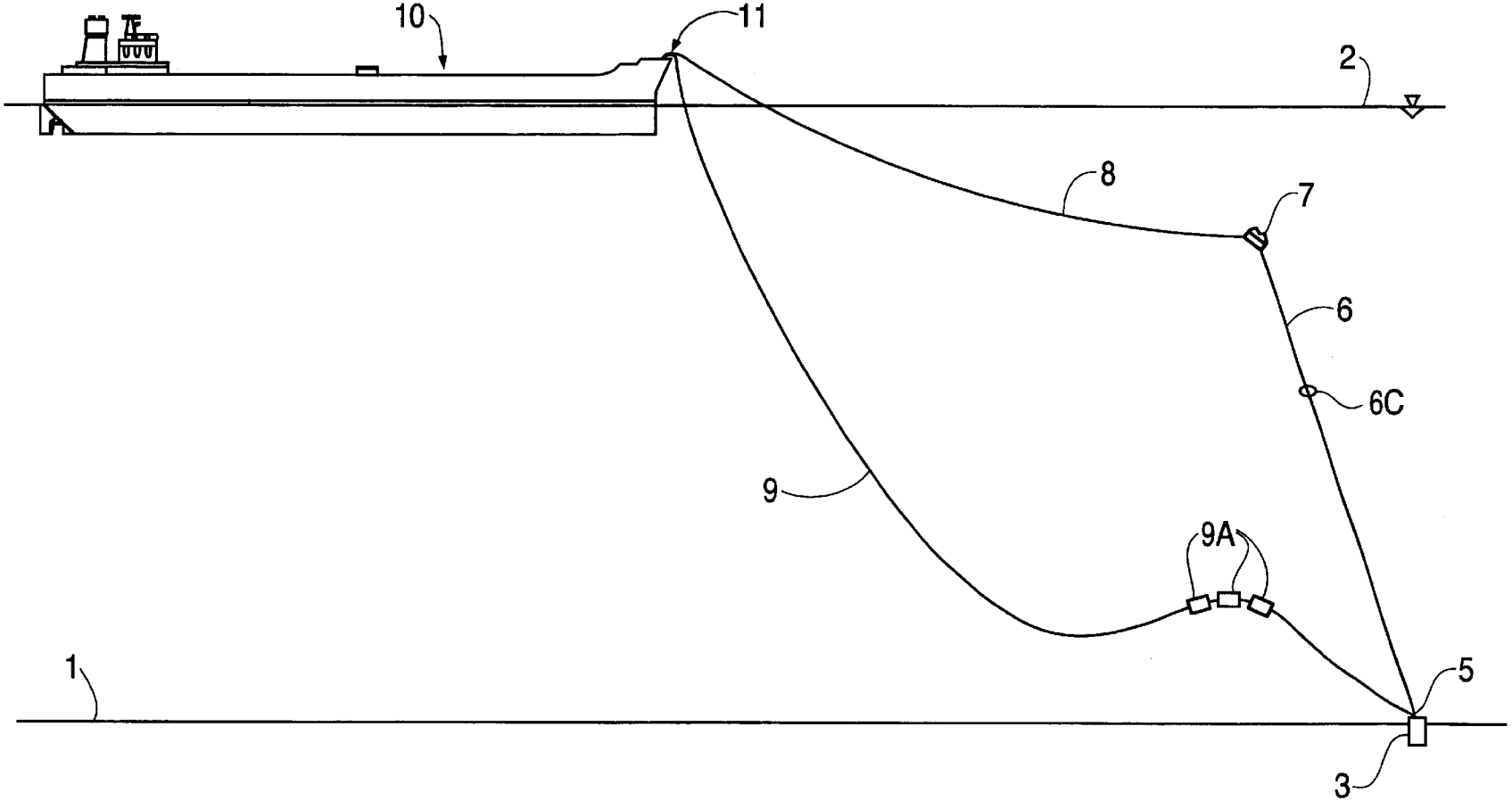
Figure 3:
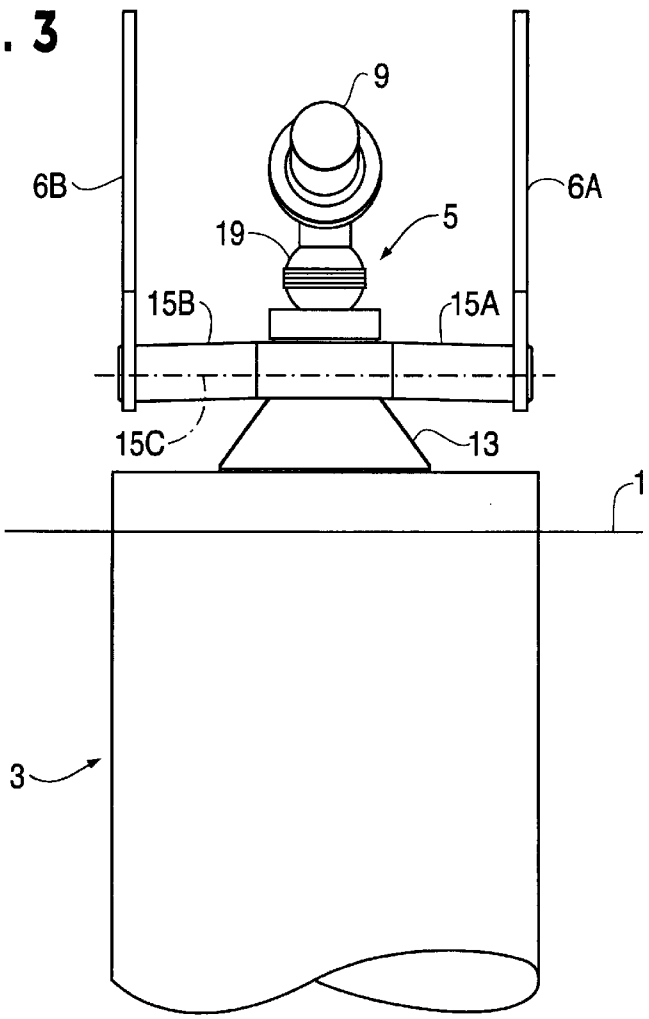
Figure 2:
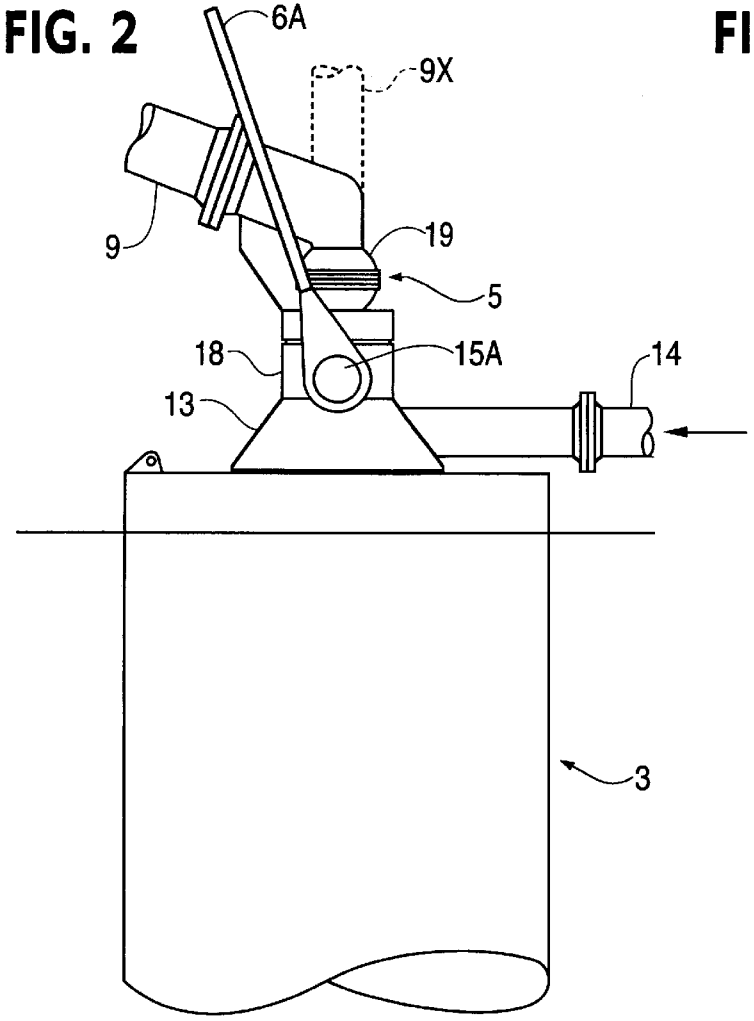

In the following description the invention will be explained more closely with reference to the drawings, in which:

FIG. 1 schematically shows a first embodiment of the system according to the invention, FIG. 2 more in detail and elevation shows an anchor with associated swivel means, which can be included in a system according to the invention, and FIG. 3 shows the same as FIG. 2 in front elevation.

In FIG. 1 of the drawings the seabed is indicated at 1 and the sea surface at 2, as well as substantially the whole system according to the invention and the total arrangement involved in a mooring situation with associated operations. There is here in the first place the question of a ship 10, usually a tanker, an anchor 3 at the seabed 1 and an anchoring line with two parts 6 and 8 being at a middle portion provided with a buoyant body 7, also denoted line buoy. In the usual manner the ship 10 is equipped with mooring means 11 at the bow, without any details being shown more closely at this point.

The system according to the invention as described so far, is sufficient for the desired mooring of the ship 10, and in this connection involves advantages as already mentioned in the introduction above. An important feature of the mooring system is the line buoy 7, which is preferably located at or connected to a middle portion of the total anchoring line 6, 8. It is obvious that buoy 7 does not need to be exactly at the middle of the total line length, but in order that the desired effect be obtained, it is and advantage that the buoy is positioned at a good distance both from the lower end of anchoring line 6 at anchor means 3, and from the upper end of anchoring line 8 at mooring means 11.

The dimensions of buoy 7 are chosen so that under most conditions or stresses a quite significant angle difference between the adjacent portions of line parts 6 and 8 is established. Thus line part 6 will normally extend upwards from anchor 3 at a clearly smaller angle in relation to the vertical, than the angle at which line part 8 runs out from buoy 7. When the ship 10 is strongly affected by wind, waves or ocean currents, the whole anchoring line 6, 8 may be tightened more than shown e.g. in FIG. 1, so that buoy 7 is pulled deeper into the water and the angle between line parts 6 and B can approach more or less 180°. As an opposite extreme when a minimum of mooring forces are acting, buoy 7 may float to the sea surface 2, if the length of line part 6 is larger than the water depth.

The latter situation will be most likely to occur in the case of operations taking place near the coast or in more closed waters, such as at tanker terminals or the like. When operations and installations in more rough waters are concerned, e.g. far out at sea, buoy 7 as a rule will be located well immerged under the sea surface. This is per se a very favorable situation for the buoy and the whole system, since the buoy when located deep in the water is less subjected to influence from wind and waves occurring at the sea surface. It is also an important effect of buoy 7 that under substantially all conditions this will maintain anchoring line part 6 tensioned upwards from anchor 3, so that no part of the anchoring line will be lying on the seabed 1.

There may also be cases where this buoy device comprises more than one individual buoy, but still so arranged that there is provided a relatively limited deflection portion more or less at the middle of the total anchoring line. The main purpose of such a buoy or buoy device is to provide for a relatively concentrated buoyancy in the anchoring line, which results in a soft or flexible behaviour of the whole mooring system, with reduced dynamic load effects.

In addition to the pure mooring function being explained above, such a system can also comprise fluid transfer between the anchor means 3 and the ship 10, such as loading thereof with hydrocarbons. Thus in FIG. 1 there is shown a relatively flexible hose 9 being extended up to the bow portion of the ship 10, which is there provided with suitable connection means, that may very well be combined with the mooring means 11. Such means can be of designs being known per se. At a lower portion of hose 9 there are shown buoyant elements 9A, which in this case are provided in a number of three, but can of course vary in number and dimensions depending on the desired shape of hose 9. A primary purpose of buoyant elements 9A is to secure that the lower portion of hose 9 is generally always elevated from seabed 1. It is a great advantage that hose 9 runs through the water well underneath anchoring line 6, 8, as illustrated in FIG. 1. Thereby any contact between the two main parts of the system is avoided, in particular so that hose 9 will not be damaged by any part of anchoring line 6, 8.

Fluid transfer as mentioned above especially for loading a tanker, but also possibly for unloading, is more particularly the subject matter of the simultaneously filed international patent application PCT/NO96/00202 (our ref. INT6152L).

FIGS. 2 and 3 in more detail show a possible and preferred design of the anchor 3 with associated equipment, in particular a swivel device 5 at the top of anchor 3. According to the invention this preferably has the form of a suction anchor, which can be of a design as known per se, and adapted to penetrate into loose masses underneath the actual seabed 1 in order to obtain a strong anchoring effect. In the example shown in FIGS. 2 and 3 the suction anchor 3 thus has a downwardly open cylindrical shape.

Centrally on top of anchor 3 there is shown a fixed carrier member 13 which supports the actual swivel device 5. This has an upper connection member 19 with a pipe bend to which the lower end of hose 9 is connected, e.g. by a flange connection. The lower swivel part 18 serves for the attachment of two line parts 6A and 6B as shown more in detail in FIG. 3. Line parts or portions 6A and 6B constitute the lower end of a so-called crowfoot having an apex at 6C (FIG. 1) so that the crowfoot as a whole has the shape of a preferably isosceles triangle the base line of which is formed by an arm structure 15A, 15B. This is cantilevered to each side from the lower swivel member 18 and is adapted to be rotated together with the swivel part about the central axis of the complete anchor and swivel means. Arms 15A and 15B have a common horizontal axis 15C and line portions 6A and 6B respectively, are connected to the outer ends of arms 15A and 15B so as to be pivotable about the axis 15C. An important purpose of arms 15A and 15B is to provide for a sufficient torque for the swivel movement about the central, vertical axis, depending upon the direction of the mooring force from the ship 10 through the anchoring line 6, 8. Swivel members 18 and 19 are united with respect to rotation.

In the arrangment described above in addition to rotation about a vertical axis, there is the possibility also of pivoting or articulation about a horizontal axis, namely axis 15C. Instead of a more or less flexible crowfoot as mentioned, there can also be provided a more rigid, yoke-like design being incorporated in the anchor means as a whole. Both in the case of a crowfoot and in the case of a rigid yoke conventional attachment means or methods can be employed for the lower ends of the anchoring lines. Here there may also be the question of a relatively permanent attachment or a connection that can be relatively easily losened, that can e.g. be manipulated by means of an robot operated vehicle. Such a possibility of detachable fastening consists in a device of the type "chain stopper", which can be self-locking and otherwise can allow for manipulation or operation as known per se.

As seen in particular from FIG. 2 hose 9 has a direction outwards and upwards from swivel means 5 at a smaller angle in relation to the horizontal than anchoring line portion 6A. When besides hose 9 as shown in FIG. 3, runs out centrally between line portions 6A and 6B, there is minimal risk of damage to hose 9 by contact with any portion of the anchoring line.

As a possible, but not preferred alternative, there is indicated at 9X a direction of the hose directly upwards centrally from swivel means 5, which implies that such a hose somewhere higher up in the water will have to cross or pass by the anchoring line 6, 8. This is usually a less favorable solution. Finally FIG. 2 shows a pipeline 14 connected for supplying e.g. produced fluid, such as hydrocarbons, to the anchor installation 3, namely the stationary carrier member 13 thereof for the swivel means 5.

The system described here can e.g. be intended for operation at water depths from 150–300 meters. At a depth of e.g. 200 meters the two parts 6 and 8 of the total anchoring line can typically be 160 meters and 200 meters respectively, in a favourable practical embodiment.

Otherwise it is obvious that various modifications and variants can be contemplated within the framework of the invention. Thus when it is stated that anchor 3 is permanent, this does not mean e.g. that a suction anchor or a gravitation anchor must remain forever at the seabed 1, upon being installed. As known even such relatively fixed installations at the seabed can be removed by suitable means and equipment. A permanent anchor device in this context means a more permanent anchor than what is typically carried by a ship and can be thrown from this or hauled into the ship by means of its normal anchor capstan.

A method of installation of an anchor device in the system as explained above, according to the invention with advantage can consist in that the anchor is suspended at the end of an anchor chain or wire belonging to a generally regular anchor capstan or winch of the ship concerned, being employed for lowering the anchor to a predetermined point at the seabed.

In FIG. 1 there is illustrated an apex 6C of the crow-foot as also explained with reference to FIGS. 2 and 3, but it is obvious that the position of apex 6C can vary considerably, and possibly the apex can be adjacent to or on the buoyant body or buoy 7. In the case of an approximate vertical direction of the hose (as shown at 9X) from swivel means 5 in FIG. 2, it can be expedient to let the hose cross or pass by the anchoring line 6 between the two portions 6A and 6B thereof in the crowfoot, at a portion higher up in the water. It is also possible to let this crossing take place adjacent to the buoy 7 when the apex 6C is correspondingly located, whereby the hose in such case can also be suspended from the buoy at this location.

Instead of a crowfoot as a prolongation of the anchoring line, as described above, the system described here with associated anchor means can also be provided with a yoke or similar structure as shown and described in the above mentioned, simultaneous international patent application.

What is claimed is:

1. A system for mooring ships, for operations in connection with oil and gas activity, whereby a ship is equipped with a mooring device and where there is included an anchor device located at the seabed, as well as at least one anchoring line adapted to connect said anchor device to said mooring device on the ship, wherein said anchor device is a permanent anchor device being provided with swivel device for said anchoring line, said swivel device having a rotation axis;

a buoyant body attached to a middle portion of the anchoring line, and adapted during anchoring to be normally immersed in the sea; and a crowfoot provided at a lower portion of the anchoring line and connected to said swivel device, whereby said swivel device comprises two cantilevered arms having outer ends to which the anchoring lines of the crowfoot are attached, said two cantilevered arms extending substantially perpendicular to the rotation axis of the swivel device.

2. The system of claim 1, wherein said anchoring lines of the crowfoot are pivotable about an axis between the cantilevered arms.

3. The system of claim 1, wherein said anchor device comprises one from the group consisting of a suction anchor, gravitation anchor and pile anchor.

4. The system of claim 1, wherein said two cantilevered arms have a common axis.

* * * * *